US011424542B2

(12) United States Patent
Hamabe

(10) Patent No.: US 11,424,542 B2
(45) Date of Patent: Aug. 23, 2022

(54) ANTENNA DEVICE

(71) Applicant: Panasonic Intellectual Property Management Co., Ltd., Osaka (JP)

(72) Inventor: Taichi Hamabe, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 37 days.

(21) Appl. No.: 16/952,741

(22) Filed: Nov. 19, 2020

(65) Prior Publication Data

US 2021/0159598 A1 May 27, 2021

(30) Foreign Application Priority Data

Nov. 22, 2019 (JP) ..... JP2019-211491

(51) Int. Cl.

| | |
|---|---|
| ***H01Q 9/04*** | (2006.01) |
| ***H01P 5/02*** | (2006.01) |
| ***H01Q 5/335*** | (2015.01) |
| ***H01Q 1/50*** | (2006.01) |
| ***H01Q 13/08*** | (2006.01) |
| ***H01Q 1/36*** | (2006.01) |

(52) U.S. Cl.

CPC ..... *H01Q 9/045* (2013.01); *H01P 5/02* (2013.01); *H01Q 1/36* (2013.01); *H01Q 1/50* (2013.01); *H01Q 5/335* (2015.01); *H01Q 13/08* (2013.01)

(58) Field of Classification Search

CPC ..... H01Q 9/045; H01Q 1/36; H01Q 1/50; H01Q 5/335; H01Q 13/08

See application file for complete search history.

(56) References Cited

U.S. PATENT DOCUMENTS 4,843,400 A 6/1989 Tsao et al.
5,376,942 A 12/1994 Shiga
(Continued)

FOREIGN PATENT DOCUMENTS

JP 3-148902 6/1991
JP 2005-124056 5/2005
(Continued)

OTHER PUBLICATIONS

Shinji Nakano et al., "Wide Band Impedance Matching of a Polarization Diversity Patch Antenna by Use of Stubs Mounted on the Patch", Nov. 2003, The Transactions of the Institute of Electronics, Information and Communication Engineers B, vol. J86-B, No. 11, pp. 2,428-2,432, with English translation and cited in the specification.

(Continued)

*Primary Examiner* — Hoang V Nguyen

(74) *Attorney, Agent, or Firm* — Wenderoth, Lind & Ponack, L.L.P.

(57) ABSTRACT

The antenna device includes an antenna surface having an antenna conductor, a ground surface facing the antenna surface and having a ground conductor, and a stub including a plurality of transmission lines coupled in series, the plurality of transmission lines having different line widths. The stub is located between the antenna surface and the ground surface. The antenna conductor electrically conducted to the stub via a feeding point coupled to a transmission line on one end side, of the plurality of transmission lines.

8 Claims, 10 Drawing Sheets

(56) References Cited

U.S. PATENT DOCUMENTS

| | | | |
|---|---|---|---|
| 6,326,920 | B1 | 12/2001 | Barnett et al. |
| 6,335,703 | B1 | 1/2002 | Chang et al. |
| 2006/0097926 | A1 | 5/2006 | Fujii et al. |
| 2007/0257842 | A1 | 11/2007 | Tseng |
| 2012/0105302 | A1 | 5/2012 | Kato et al. |
| 2019/0067834 | A1 | 2/2019 | Park et al. |

FOREIGN PATENT DOCUMENTS

| | | | |
|---|---|---|---|
| JP | 2006-135672 | 5/2006 | |
| WO | 2005/024998 | 3/2005 | |
| WO | WO-2019151529 A1 * | 8/2019 | ..... H01Q 1/38 |

OTHER PUBLICATIONS

Rowe et al., "Edge-Fed Patch Antennas With Reduced Spurious Radiation", IEEE Transactions on Antennas and Propagation, vol. 53, No. 5, May 2005, pp. 1785-1790.

International Search Report dated Feb. 19, 2019 in International (PCT) Application No. PCT/JP2018/048586, with English translation.

Office Action dated Nov. 5, 2021 in U.S. Appl. No. 16/912,937.

Office Action dated Jan. 26, 2022 in U.S. Appl. No. 16/912,937.

* cited by examiner

ANTENNA DEVICE

BACKGROUND

1. Field of the Invention

The present disclosure relates to an antenna device.

2. Description of the Related Art

Non-patent Literature 1 discloses, as an antenna device mounted at a mobile communication terminal, a patch antenna using a communication frequency of 2 GHz band, for example. To widen the bandwidth of the communication frequency, this patch antenna has a three-layer structure having: a ground surface stacked in the lower layer; an antenna surface stacked in an intermediate layer; and a stub formed of a transmission line stacked in the upper layer.

Non-patent Literature 1: Keisuke NOGUCHI, and four other persons, "Wide Band Impedance Matching of a Polarization Diversity Patch Antenna by Use of Stubs Mounted on the Patch", November, 2003, The Transactions of the Institute of Electronics, Information and Communication Engineers B Vol. J86-B No. 11 pp. 2428-2432

SUMMARY

The present disclosure is designed in consideration of the above-mentioned conventional situation, and provides an antenna device that balances widening the bandwidth of the communication frequency and improving the gain as the antenna performance, without increasing the whole thickness of the antenna device itself.

The antenna device of the present disclosure includes: an antenna surface having an antenna conductor; a ground surface facing the antenna surface and having a ground conductor; and a stub including a plurality of transmission lines coupled in series, the plurality of transmission lines having different line widths. The stub is located between the antenna surface and the ground surface. The antenna conductor electrically conducted to the stub via a feeding point coupled to a transmission line on one end side, of the plurality of transmission lines.

In the present disclosure, the antenna device can balance widening the bandwidth of the communication frequency and improving the gain as the antenna performance, without increasing the whole thickness of the antenna device itself.

DETAILED DESCRIPTION OF THE PREFERRED EMBODIMENT(S)

(History to the Present Disclosure)

In the configuration of non-patent literature 1, an antenna surface as a second layer is disposed between a ground surface as a third layer and a stub as a first layer. Therefore, there is a problem that the interval between the antenna surface and ground surface is narrow, Q value showing the sharpness of the peak of the resonance frequency characteristic increases, and further widening the bandwidth in radio communication is difficult. On the other hand, in downsizing the antenna device, the whole thickness of the antenna device itself in a casing of an electronic device, which is a final product on which the antenna device is mounted, is apt to be restricted. Therefore, in the configuration of the antenna device in non-patent literature 1, the interval between the antenna surface and ground surface cannot be widened. In other words, the reduction of the Q value of the patch antenna is difficult, further widening the frequency bandwidth used for radio communication is difficult, and improving the gain as the antenna performance is difficult.

Thus, the following first exemplary embodiment describes, one example of an antenna device that balances widening the bandwidth of the communication frequency and improving the gain as the antenna performance, without increasing the whole thickness of the antenna device itself.

Hereinafter, appropriately with reference to the accompanying drawings, the exemplary embodiment specifically disclosing the antenna device of the present disclosure is described in detail. A more detailed description than necessary is sometimes omitted. For example, a detailed description of an already well-known item and a duplicate description of a substantially the same configuration are sometimes omitted. Its purpose is to avoid unnecessary redundancy of the following description and to make easy the recognition by the person skilled in the art. Here, the accompanying drawing and the following description are provided so that the person skilled in the art sufficiently recognizes the disclosure, and these do not intend to restrict the main subject described in the scope of claims.

First Exemplary Embodiment

An antenna device of the first exemplary embodiment is described, taking as an example, a patch antenna (namely, MSA: microstrip antenna) mounted on a seat monitor disposed on the back surface side of the seat of an aircraft or the like. Here, an electronic device in which the patch antenna is mounted is not restricted to the above-mentioned seat monitor.

Figure 1:
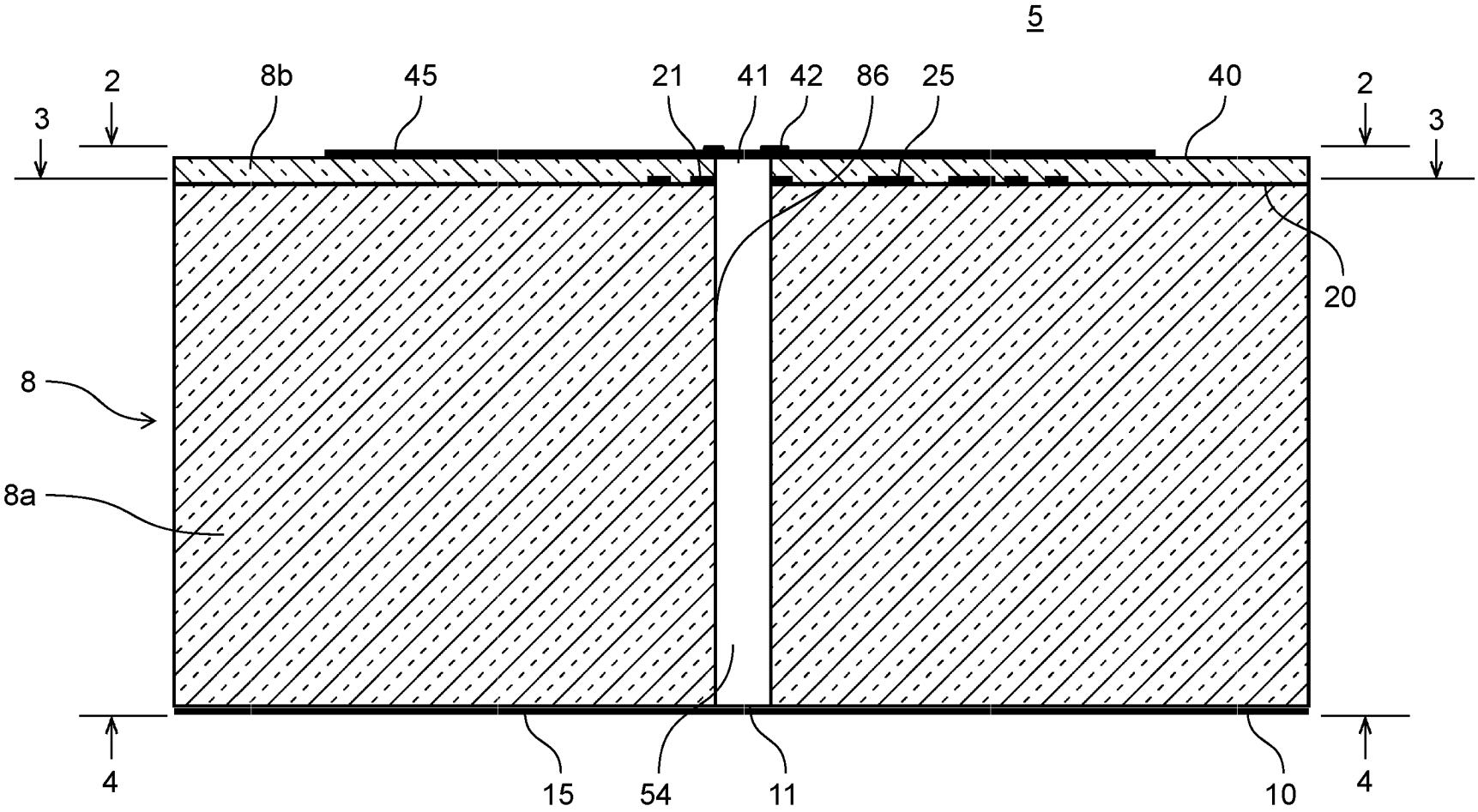
FIG. 1 is a sectional view showing one example of a lamination structure of a patch antenna in accordance with a first exemplary embodiment.

FIG. 1 is a sectional view showing one example of a lamination structure of patch antenna 5 in accordance with the first exemplary embodiment. Patch antenna 5 has substrate 8 of a three-layer structure including: ground surface 10 stacked in the lower layer; feeding surface 20 stacked in an intermediate layer; and antenna surface 40 stacked in an upper layer. Patch antenna 5 of the first exemplary embodiment transmits a radio signal of 2.4 GHz band for example (namely, radiates a radio wave). The patch antenna may transmit not only the 2.4 GHz band, but also a radio signal of 5 GHz band (namely, radiates a radio wave).

Substrate 8 is a dielectric substrate molded of a dielectric body having a high relative permeability such as PPO (Polyphenylene oxide), and has a multilayer structure in which first substrate 8*a* and second substrate 8*b* are stacked. Ground surface 10 is disposed on the back surface (rear surface) of first substrate 8*a*. Antenna surface 40 is disposed on the front surface of second substrate 8*b*. Feeding surface 20 is disposed between the front surface of first substrate 8*a* and the back surface of second substrate 8*b*. In the first exemplary embodiment, for one example, the whole thickness of substrate 8 is 2 mm, the thickness of first substrate 8*a* is 1.9 mm, and the thickness of second substrate 8*b* is 0.1 mm. A radio communication circuit (not shown) for feeding the power to patch antenna 5 is disposed on the back side of substrate 8 (namely, the back surface side of ground surface 10).

Via conductor 54 is inserted into hole 86 that penetrates from the front surface (namely, antenna surface 40) to the back surface (namely, ground surface 10) of substrate 8. Via conductor 54 is molded in a cylindrical shape by filling a conductive material into hole 86. Via conductor 54 is one conductor for conducting contact 41 formed on antenna surface 40 (namely, upper end surface of via conductor 54), feeding point 21 formed on feeding surface 20 (namely, intermediate cross section of via conductor 54), and contact 11 formed on ground surface 10 (namely, lower end surface of via conductor 54). Via conductor 54 is a feeding conductor for making antenna surface 40 function (namely, operate) as an antenna. Contact 11 is connected to the feeding terminal of the radio communication circuit (not shown) disposed on the back surface side of substrate 8.

Figure 2:
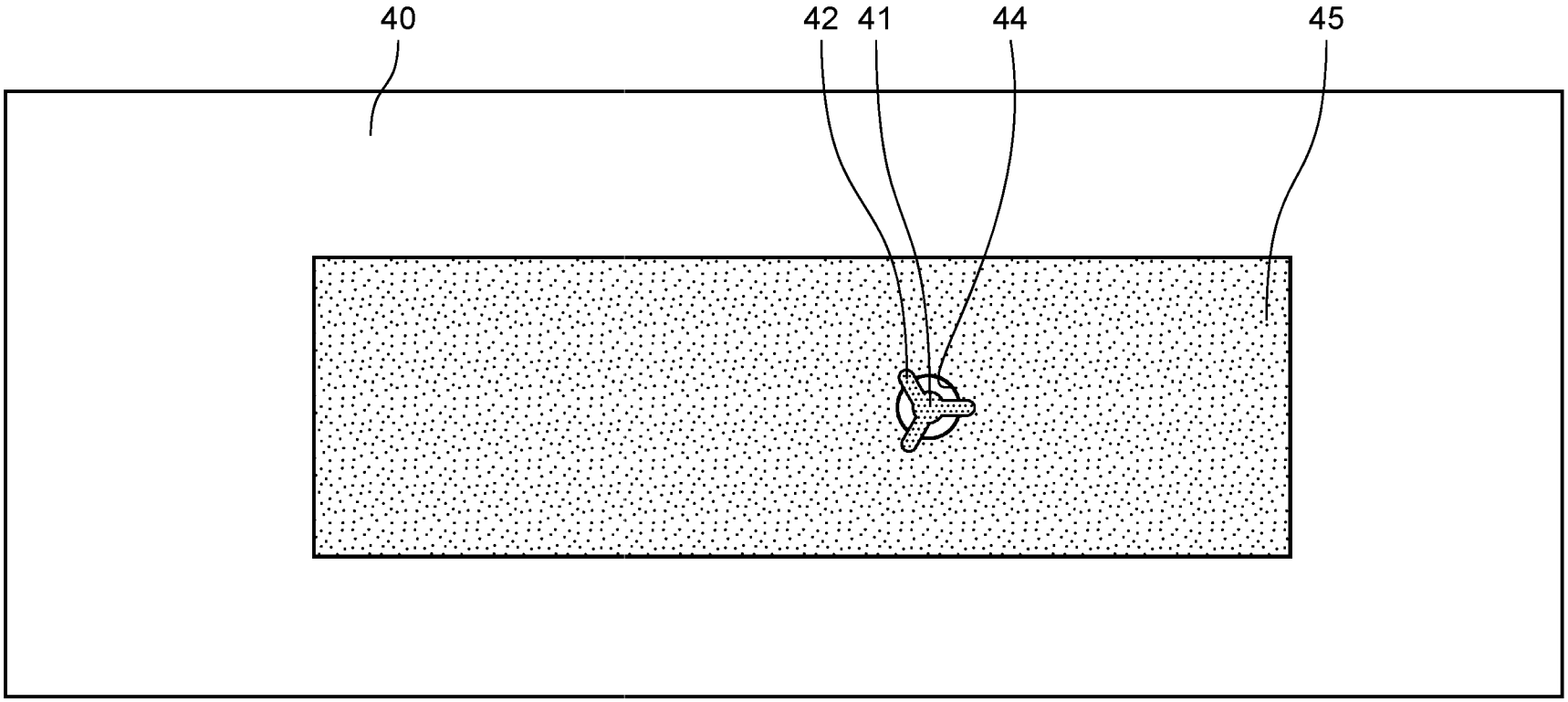
FIG. 2 is a plan view showing an antenna surface.

FIG. 2 is a plan view showing antenna surface 40. FIG. 2 shows the surface when viewed from the direction of arrow 2-2 of FIG. 1. As shown in FIG. 2, antenna surface 40 has patch 45 for radiating a radio wave corresponding to the radio signal for 2.4 GHz band, for example. Patch 45 has a characteristic of a parallel resonance circuit, and transmits the radio signal of 2.4 GHz band (namely, radiates the radio wave) in accordance with an excitation signal from a radio communication circuit (not shown) supplied to feeding point 21 of stub 25. Patch 45 is formed of a rectangular copper foil, for example. By molding the patch 45 in a rectangular shape, patch antenna 5 is disposed so that its longitudinal direction becomes horizontal when it is mounted on the electronic device such as a seat monitor. When the communication frequency is set correspondingly to the length in the longitudinal direction of patch antenna 5, the radio wave of a horizontally polarized wave is radiated relatively strong to the radio wave of a vertically polarized wave. In other words, the radio wave radiated from patch antenna 5 is apt to become the horizontally polarized wave. Opening 44 is formed at one place on the surface of patch 45. Contact 41 (namely, the tip surface of via conductor 54) is exposed to the center of opening 44. The periphery of patch 45 forming opening 44 short-circuits (short) with contact 41 via conductive member 42. Conductive member 42, as one example, is a solder that is formed by soldering the clearance between the periphery of patch 45 and contact 41 at three places. Conductive member 42 may be a wire that is obtained by connecting the periphery of the patch to the contact through a wire bonding.

Figure 3:
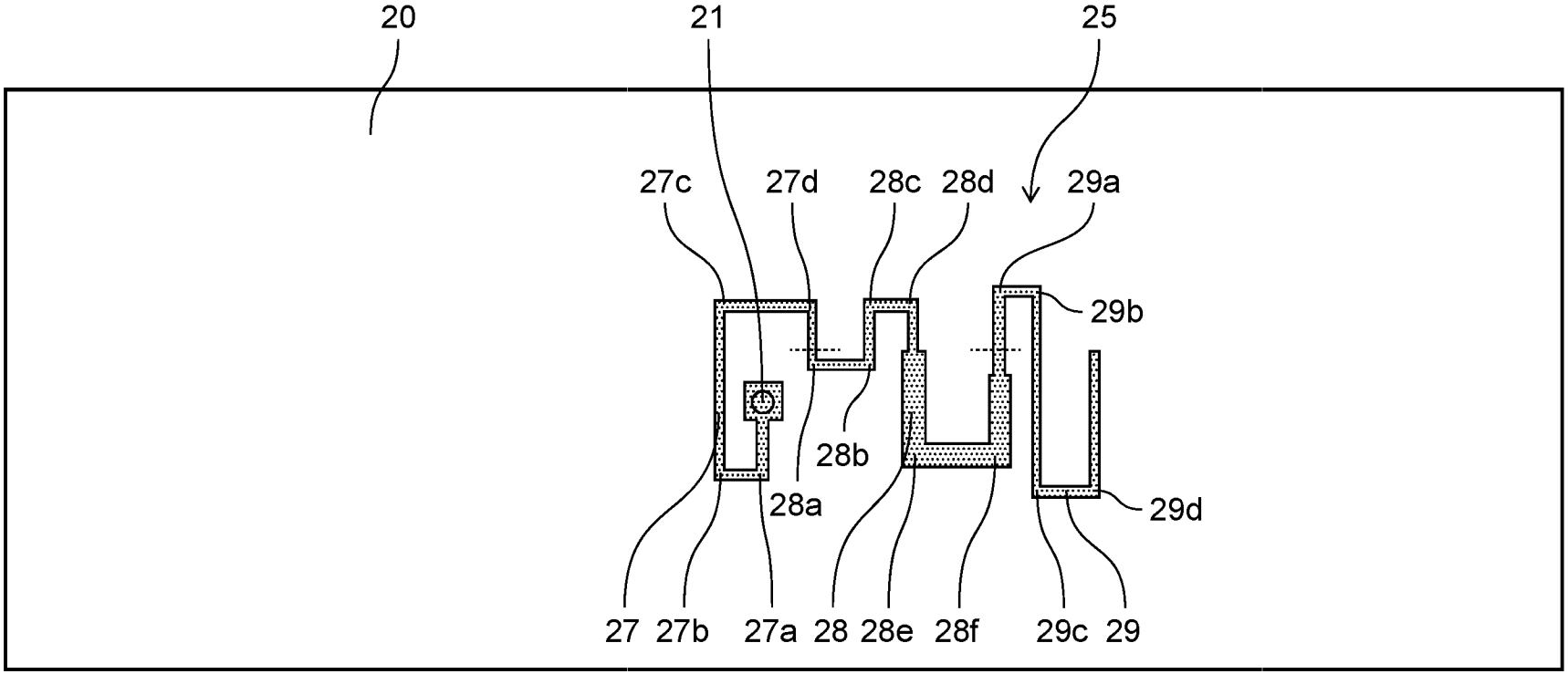
FIG. 3 is a plan view showing a feeding surface.

FIG. 3 is a plan view showing feeding surface 20. FIG. 3 shows the cross section when viewed from the direction of arrow 3-3 of FIG. 1. As shown in FIG. 3, feeding surface 20 has stub 25 as one example of a feeding line. In order to take the impedance matching of patch antenna 5, stub 25 has a characteristic of a series resonance circuit that is conducted to patch 45 through via conductor 54 and is connected to patch 45 in series. In other words, stub 25 is connected to patch 45 in series, and brings the reactance component of patch antenna 5 closer to value 0.

Stub 25 has a shape in which feeding point 21, first transmission line 27, second transmission line 28, and third transmission line 29 are interconnected in series. Line widths of first transmission line 27, second transmission line 28, and third transmission line 29 are different from each other. These plurality of transmission lines are lines that start from feeding point 21 and bend in a zigzag shape. The transmission lines include not only a narrow line part, but also a wide line part in order to make the line length of stub 25 as short as possible. The impedance of the wide line part is lower than that of the narrow line part. Reducing the impedance suppresses the power loss during power supply.

First transmission line 27 starts from feeding point 21, and has five lines orthogonally bending at four folded parts 27*a*, 27*b*, 27*c*, and 27*d*.

Second transmission line 28 has seven lines orthogonally bending at six folded parts 28*a*, 28*b*, 28*c*, 28*d*, 28*e*, and 28*f*, and includes substantially recessed line having a line width wider than that of the first transmission line 27 and third transmission line 29.

Third transmission line 29 ends at the end, and has five lines orthogonally bending at four folded parts 29*a*, 29*b*, 29*c*, and 29*d*.

The lengths (so-called, line lengths) of first transmission line 27, second transmission line 28, and third transmission line 29 are the same, $\lambda/4$ ($\lambda$: wavelength of resonance frequency). The whole lengths of first transmission line 27, second transmission line 28, and third transmission line 29, namely the line length of stub 25 equals to ¾ of communication frequency $\lambda$.

By disposing stub 25 on feeding surface 20, the voltage standing wave ratio (VSWR) of the radio signal transmitted from patch antenna 5 becomes high, and the radiation efficiency of the radio signal (namely, radio wave) transmitted from patch antenna 5. When the line width of the transmission line of stub 25 is narrow, however, the impedance increases and the loss of communication power through the transmission line increases. As a result, the transmission power for signal transmission amplified by the radio communication circuit (not shown) is not so used for radiation of the radio wave. The gains on a high frequency side and a low frequency side of the center frequency (namely, resonance frequency) as a communication object decrease, and the antenna performance reduces (see, FIG. 7, FIG. 8, and FIG. 9). In order to reduce the loss of the transmission power through the transmission line (namely, to decrease the impedance of the transmission line), the line width of the transmission line is desired to be widened. When the line width is widened, however, it is difficult to shorten the whole length of stub 25 (namely, line length), and, as a result, hence downsizing of patch antenna 5 becomes difficult. In other words, between the downsizing of patch antenna 5 and the increase of the line width of the transmission line, there is a trade-off relationship.

Therefore, in the first exemplary embodiment, patch 45 is short-circuited with feeding point 21 on antenna surface 40 without greatly changing the whole length of stub 25 and line width. Thus, the reduction of the gains on a low frequency side and a wide frequency side of the center frequency (namely, resonance frequency) as a communication object is suppressed.

Figure 4:
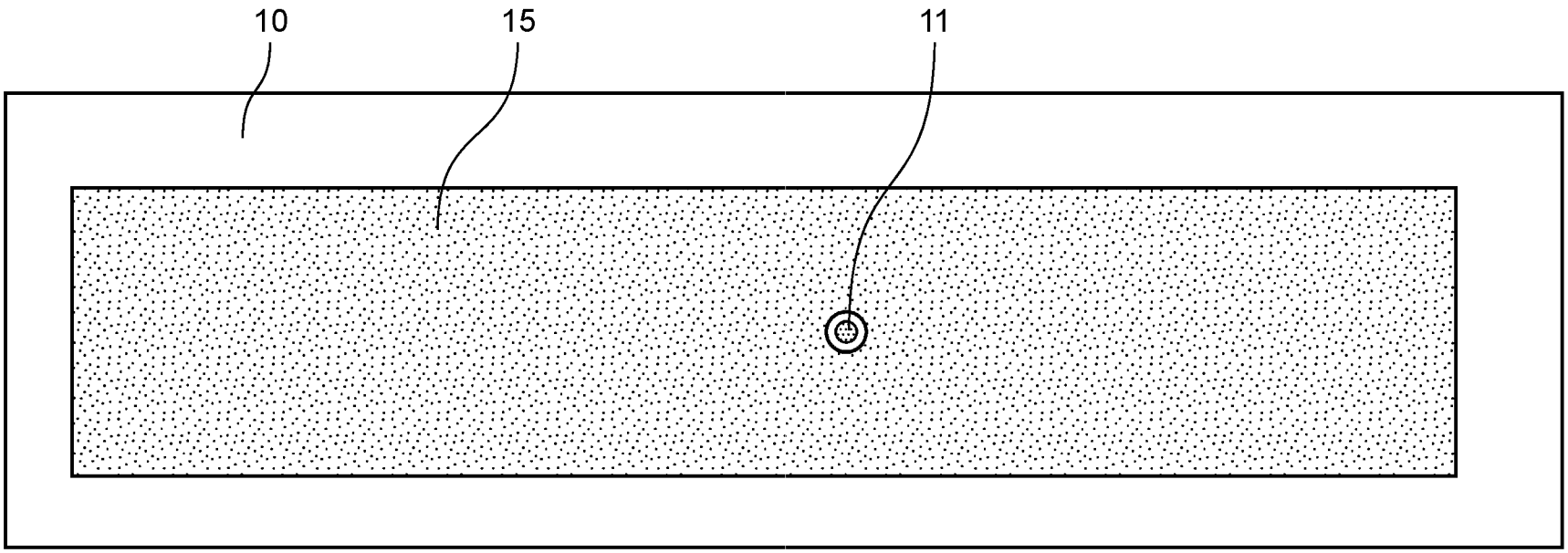
FIG. 4 is a plan view showing a ground surface.

FIG. 4 is a plan view showing ground surface 10. FIG. 4 shows the cross section when viewed from the direction of arrow 4-4 of FIG. 1. Ground conductor 15 is disposed on ground surface 10. Ground conductor 15 is made of the material of copper foil, and is formed in a rectangular shape substantially on the whole of the back surface of subtract 8. The length of the whole periphery of ground conductor 15 is set longer than that of the whole periphery of patch 45 by one or two wavelengths. When the whole periphery of ground conductor 15 becomes long, patch 45 is apt to resonate, and the length of the whole periphery of patch 45 can be also increased in accordance with ground conductor 15. Ground conductor 15 is insulated from contact 11 that conducts with via conductor 54, as shown in FIG. 4.

Figure 5:
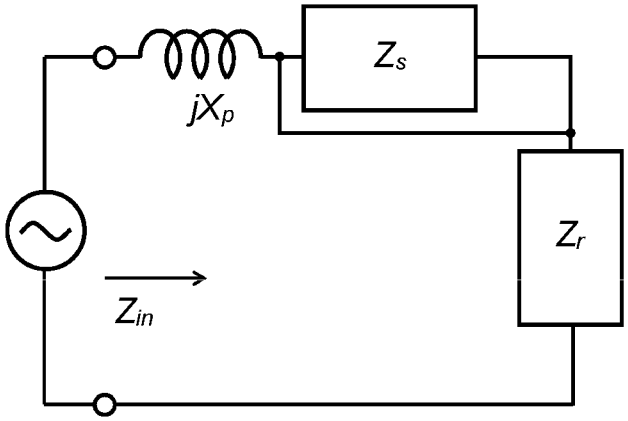
FIG. 5 is a diagram showing one example of an equivalent circuit of the patch antenna.

FIG. 5 is a diagram showing one example of an equivalent circuit of patch antenna 5. The equivalent circuit of patch antenna 5 is shown by the circuit in which impedance Zr, impedance Zs, and reactance jXp are interconnected in series as shown in FIG. 5. Impedance Zr is an impedance contributing to the radiation of patch 45. Impedance Zs is an impedance of the series resonance circuit by stub 25. Reactance jXp is a reactance of the probe for feeding. The probe for feeding is a conductor that travels from the feeding terminal of the radio communication circuit (not shown) to feeding point 21 via contact 11 and via conductor 54. Feeding point 21 is short-circuited (short) with patch 45 via conductive member 42.

Next, the performance and operation of patch antenna 5 of the first exemplary embodiment are described.

First, the performance of patch antenna 5 is described.

In patch antenna 5 of the first exemplary embodiment, patch 45 disposed on antenna surface 40 is short-circuited with contact 41 of via conductor 54. Here, as a comparative example, the performance of the patch antenna when the patch formed on the antenna surface is in non-contact (namely, non-short circuit) with the contact of the via conductor is also described (see FIG. 7 and FIG. 8). In the configuration of the patch antenna of the comparative example, except that the patch formed on the antenna surface is in non-short circuit with the contact of the via conductor, the other configuration is the same as that in the first exemplary embodiment. In other words, the non-short circuit means that the antenna surface is not conducted to the feeding surface through the via conductor.

Figure 9:
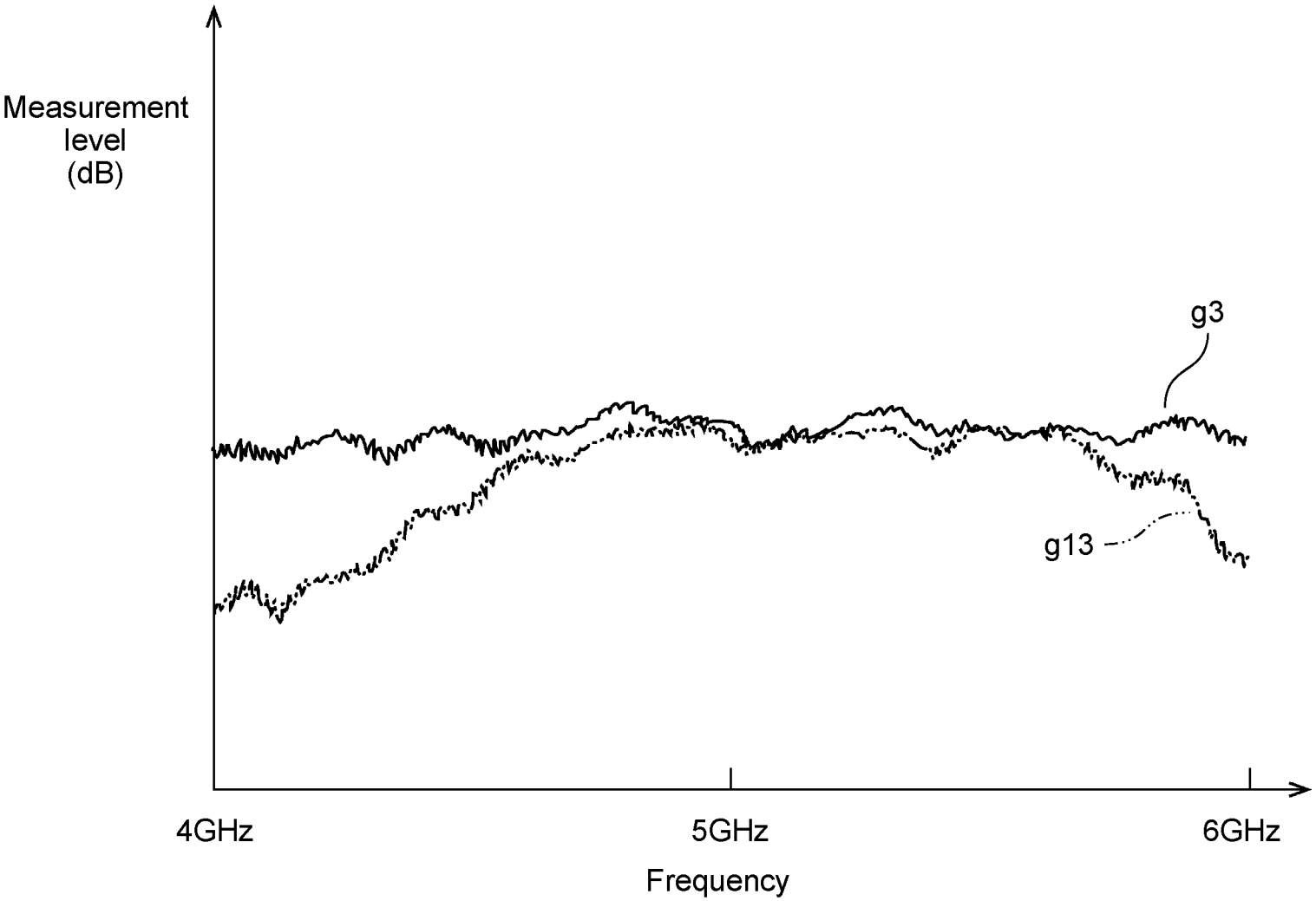
FIG. 9 is a graph showing one example of the radiation characteristic using a patch antenna for 5 GHz.

In order to compare patch antenna 5 of the first exemplary embodiment with the patch antenna of the comparative example, two types of samples (specifically, a first sample and a second sample) are used as the patch antenna for 2.4 GHz band. For example, a parameter (for example, thickness) of the patch antenna varies between the first sample and the second sample. The thickness of the patch antenna of the first sample is thicker than that of the patch antenna of the second sample. In other words, the distance between the antenna surface and the ground surface is long. As two patch antennas, the thicknesses of the patch antennas may be the same and the line lengths of the stubs may be different from each other. Furthermore, the performance of the patch antenna for 5 GHz is described (FIG. 9).

Figure 6:
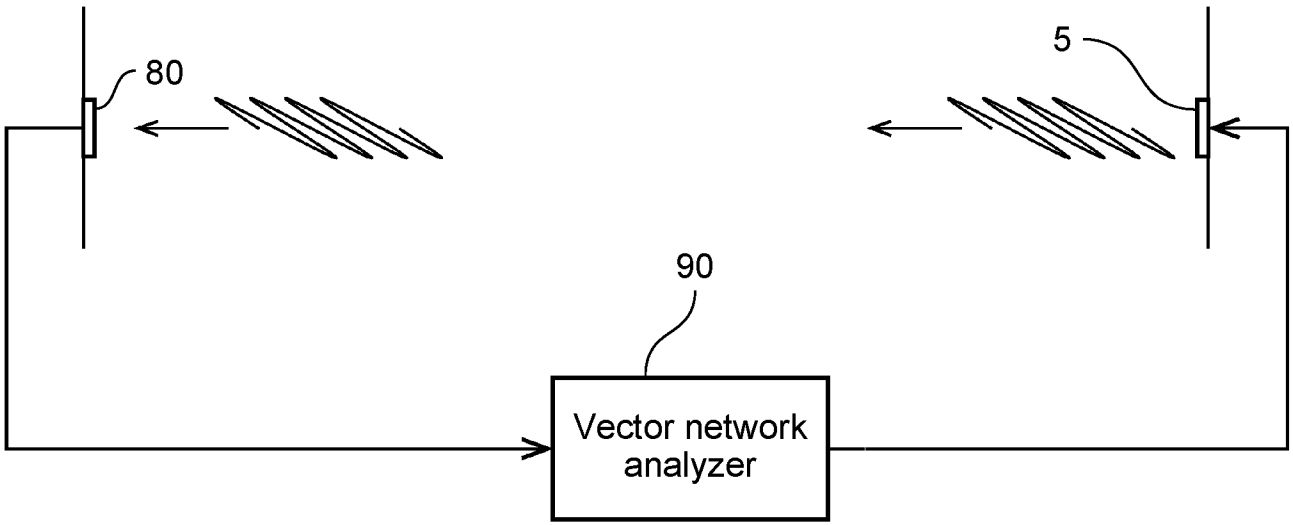
FIG. 6 is a schematic diagram showing one example of a measurement environment of the performance of the patch antenna.

FIG. 6 is a schematic diagram showing one example of a measurement environment of the performance of patch antenna 5. In this measurement environment, in addition to patch antenna 5, receiving antenna 80 and vector network analyzer (VNA) 90 are prepared. Before the start of measurement, patch antenna 5 is disposed so as to radiate the radio wave in a predetermined direction (for example, the direction facing the receiving antenna 80). In other words, on the surface facing patch antenna 5 in the predetermined direction (see above-mentioned description), receiving antenna 80 for receiving the radio wave radiated from patch antenna 5 is disposed. For example, receiving antenna 80 is pasted on a wall surface with tape. The radio wave radiated from patch antenna 5 is mainly horizontally polarized radio wave, so that receiving antenna 80 is disposed so as to be capable of receiving the horizontally polarized radio wave radiated from patch antenna 5. Patch antenna 5 is connected to an output terminal of vector network analyzer 90 via a cable. Receiving antenna 80 is connected to an input terminal of vector network analyzer 90 via a cable.

Vector network analyzer 90 feeds an excitation signal of a high frequency to patch antenna 5 while continuously changing (namely, sweeping) the frequency. Patch antenna 5 radiates the radio wave using the fed excitation signal. Receiving antenna 80 receives the radio wave radiated from patch antenna 5, and the received measurement signal (for example, signal corresponding to the electric field intensity of the radio wave) to vector network analyzer 90. Vector network analyzer 90 measures the radiation characteristic of the radio wave of patch antenna 5, on the basis of the ratio between the level of the excitation signal of the high frequency fed to patch antenna 5 and the level of the measurement signal received by receiving antenna 80. When the radiation characteristic of patch antenna 5 for 2.4 GHz is measured, for example, vector network analyzer 90 feeds the excitation signal of a high frequency while continuously changing (namely, sweeping) the frequency in the range of 2.0 GHz to 3.0 GHz, and acquires the measurement signal. Similarly, when the radiation characteristic of patch antenna 5 for 5 GHz is measured, vector network analyzer 90 feeds the excitation signal of the high frequency while continuously changing the frequency in the range of 4.0 GHz to 6.0 GHz, and acquires the measurement signal.

Figure 7:
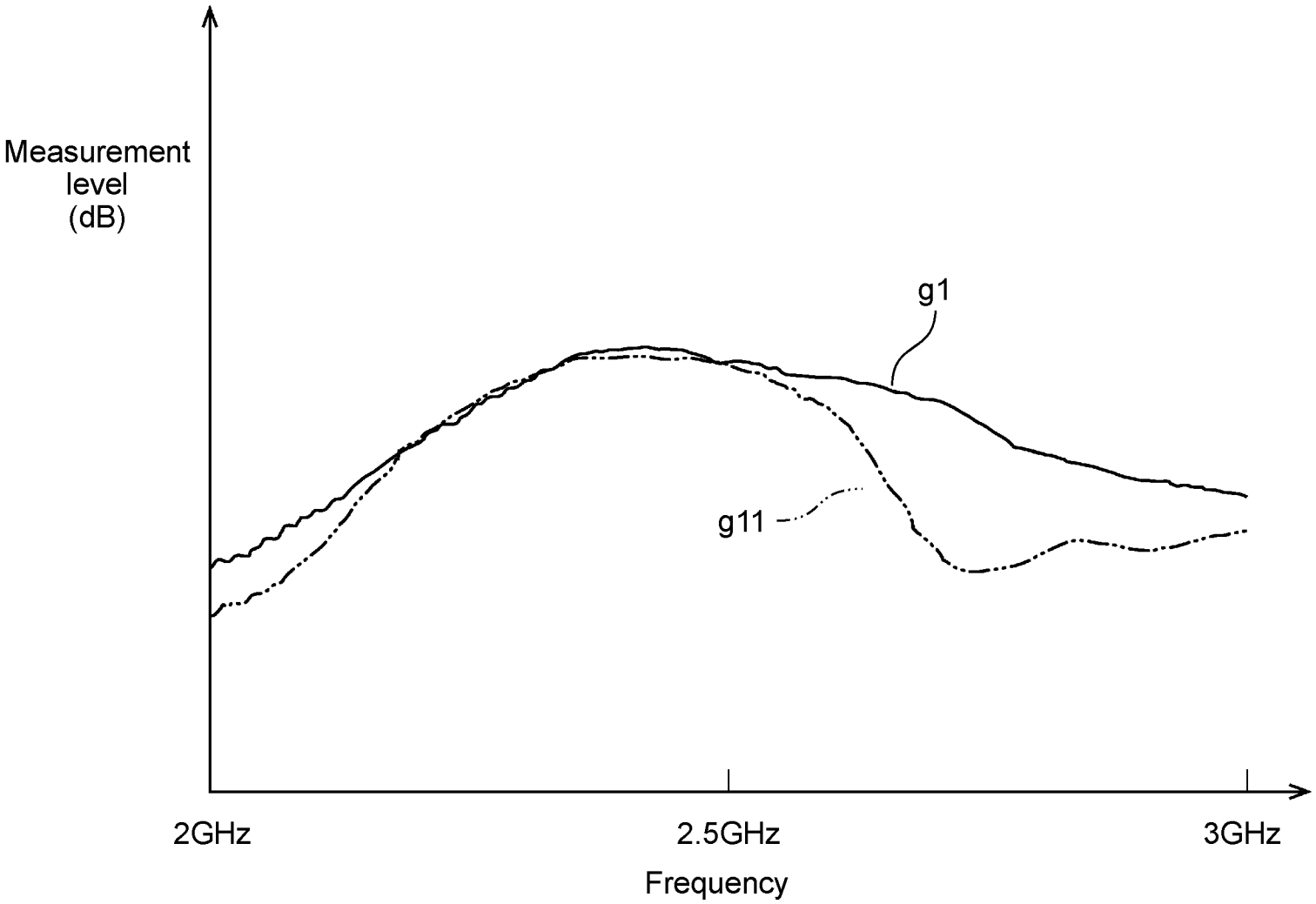
FIG. 7 is a graph showing one example of the radiation characteristic using a first sample of a patch antenna for 2.4 GHz.

FIG. 7 is a graph showing one example of the radiation characteristic using a first sample of patch antenna 5 for 2.4 GHz. Horizontal axis of FIG. 7 shows the frequency of the radio signal (namely, radio wave) transmitted by patch antenna 5. Vertical axis of FIG. 7 shows the measurement level (namely, radio wave intensity) of the radio signal (namely, radio wave) received by receiving antenna 80 (see FIG. 6). This measurement level corresponds to the gain as the antenna performance. In this measurement, vector network analyzer 90 feeds the excitation signal of a constant level to patch antenna 5 while continuously changing (namely, sweeping) the frequency in the range of 2 GHz to 3 GHz. Patch antenna 5 continuously transmits (namely, radiates) the radio signal (namely, radio wave) in accordance with the excitation signal.

As a result, as shown in FIG. 7, in patch antenna 5 of the first exemplary embodiment, as shown in graph g1 (solid line), the measurement level has a moderate peak in the band (bandwidth of 70 kHz) of 2.40 GHz to 2.48 GHz used for radio communication, and draws a gentle chevron curve as a whole on the band of 2 GHz to 3 GHz, Therefore, a large drop in the measurement level is not found.

In other words, in the patch antenna of the comparative example, as shown in graph g11 (two-dot chain line), the measurement level has a moderate peak in the band of 2.40 GHz to 2.48 GHz used for radiation communication similarly to the patch antenna 5 of the first exemplary embodiment. However, the measurement level greatly decreases on both bands on the lower band (2.0 GHz to 2.2 GHz) side and the higher band (2.60 GHz to 3.0 GHz) side than the band of 2.40 GHz to 2.48 GHz. This drop of the measurement level, namely the reduction of the gain as the antenna performance is considered to be caused by the large power loss in the stub.

Figure 8:
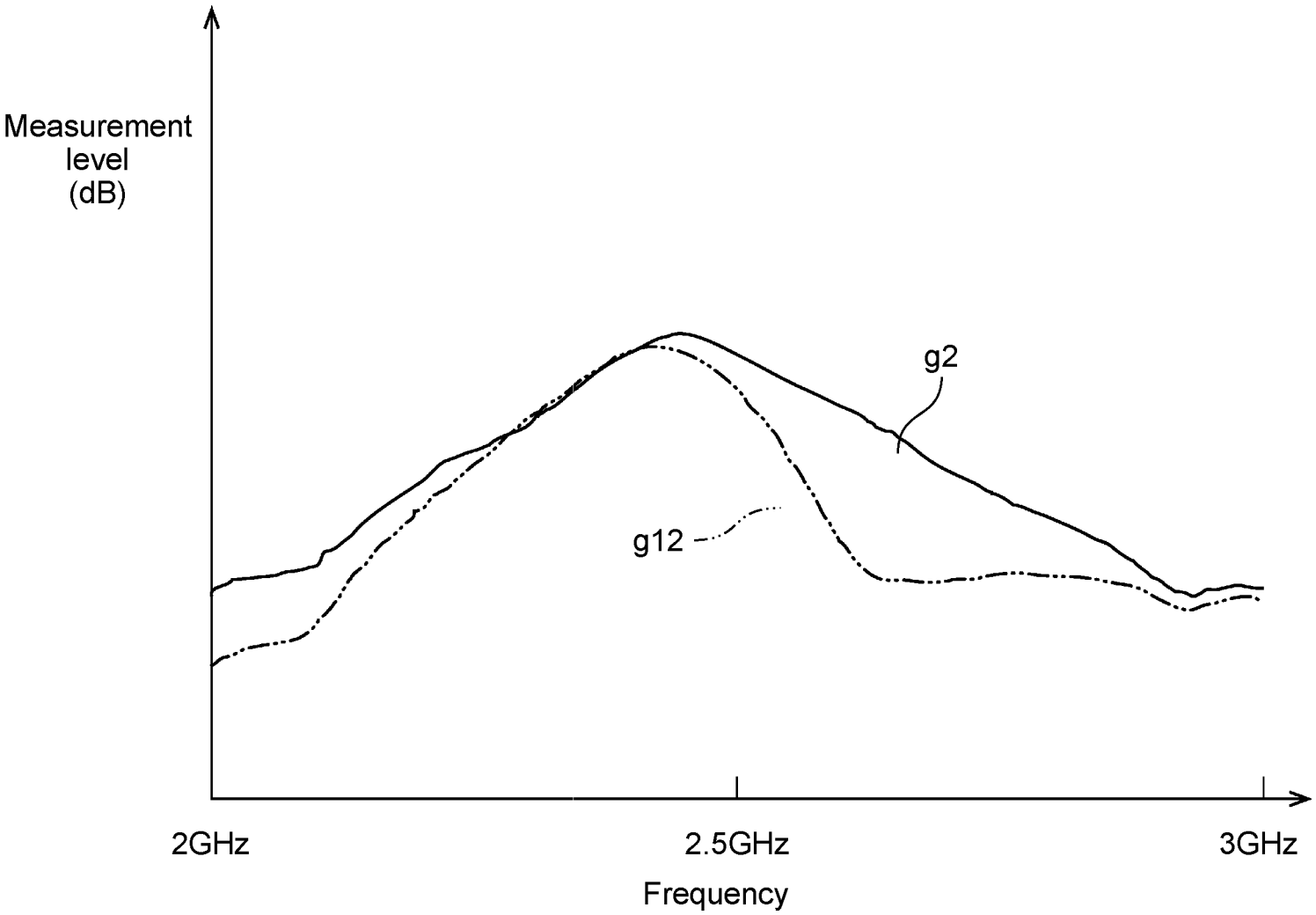
FIG. 8 is a graph showing one example of the radiation characteristic using a second sample of the patch antenna for 2.4 GHz.

FIG. 8 is a graph showing one example of the radiation characteristic using a second sample of patch antenna 5 for 2.4 GHz. Horizontal axis of FIG. 8 shows the frequency of the radio signal (namely, radio wave) transmitted by patch antenna 5. Vertical axis of FIG. 8 shows the measurement level of the radio signal (namely, radio wave) received by receiving antenna 80 (see FIG. 6). In patch antenna 5 of the first exemplary embodiment, as shown in graph g2 (solid line), the measurement level, compared with the first sample, has a peak in the band (bandwidth of 70 kHz) of 2.40 GHz to 2.48 GHz used for radio communication, and draws a sharp chevron curve as a whole in the band of 2 GHz to 3 GHz.

In other words, in the patch antenna of the comparative example, as shown in graph g12 (two-dot chain line), the measurement level has a peak in the band of 2.40 GHz to 2.48 GHz used for radiation communication. However, the measurement level greatly decreases on both bands on the lower band (2.0 GHz to 2.2 GHz) side and the higher band (2.6 GHz to 3.0 GHz) side than the band of 2.40 GHz to 2.48 GHz. This drop of the measurement level, namely the reduction of the gain as the antenna performance, is considered to be caused by the large power loss in the stub similarly to the case of the first sample.

FIG. 9 is a graph showing one example of the radiation characteristic using patch antenna 5 for 5 GHz. Horizontal axis of FIG. 9 shows the frequency of the radio signal (namely, radio wave) transmitted by patch antenna 5. Vertical axis of FIG. 9 shows the measurement level of the radio signal (namely, radio wave) received by receiving antenna 80 (see FIG. 6). In patch antenna 5 of the first exemplary embodiment, as shown in graph g3 (solid line), a large drop of the measurement level is not seen, because the measurement level draws a broadband curve changing flatly as a whole in the band of 4 GHz to 6 GHz used for the radio communication. Here, recently, the radio signal of the frequency of 6 GHz band is used in the radio LAN (local area network) such as Wifi (registered trademark), so that it is useful to correspond to the widening of the bandwidth to the higher band side.

In other words, in the patch antenna of the comparative example, as shown in graph g13 (two-dot chain line), the measurement level changes flatly, but greatly decreases in both bands on the lower band (4.0 GHz to 4.6 GHz) side and the higher band (5.7 GHz to 6.0 GHz) side than the band of 4 GHz to 6 GHz used for radiation communication. This drop of the measurement level, namely decrease of the gain as the antenna performance, is considered to be caused by the large power loss in the stub, similarly to the patch antenna for 2.4 GHz.

Figure 10:
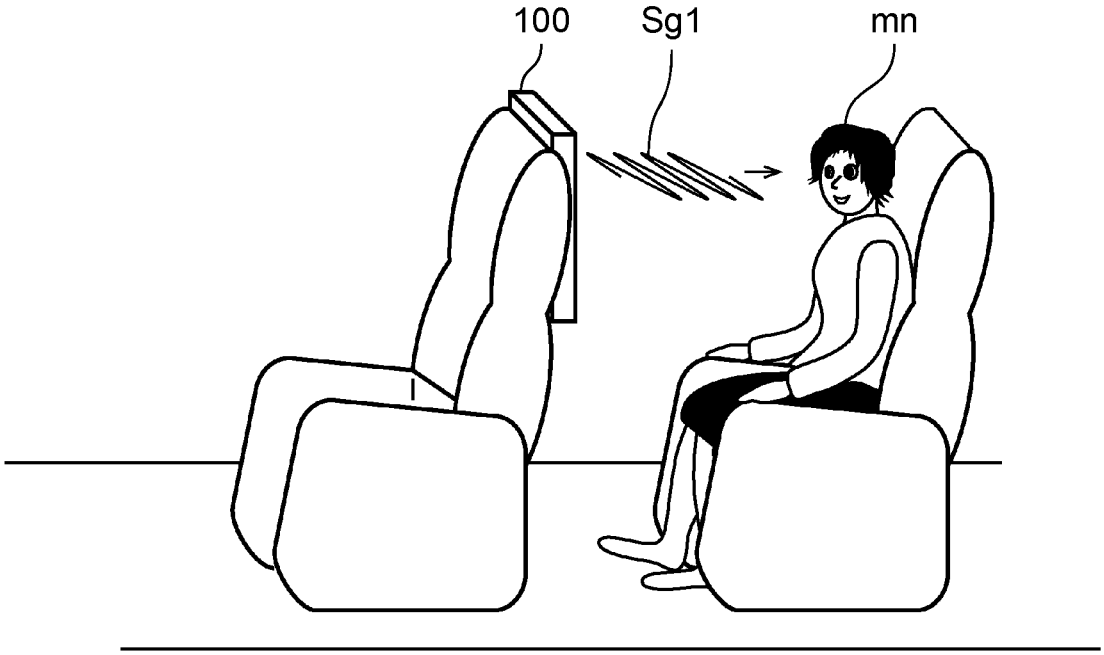
FIG. 10 is a diagram showing a use case example of a patch antenna.

FIG. 10 is a diagram showing one example of a use case of patch antenna 5. Patch antenna 5 of the first exemplary embodiment is mounted on seat monitor 100 disposed on the back side of the seat of an aircraft or the like. Seat monitor 100 is communicably connected to the data server (not shown) capable of providing delivery contents data of video or music or the like, for example. Seat monitor 100 transmits the radio signal from patch antenna 5 to the data server, and requests delivery contents data. Seat monitor 100 receives the delivery contents data transmitted from the data server using patch antenna 5. Seat monitor 100 displays video on the monitor on the basis of the delivery contents data, or radiates radio wave including data such as music from patch antenna 5 to audience mn. Here, patch antenna 5 is disposed so that the patch surface is parallel with the front surface of seat monitor 100. Patch antenna 5 is disposed so that the longitudinal direction is parallel with the floor surface of the seat. Therefore, from the front surface of seat monitor 100, radio signal Sg1 as horizontally polarized radio wave is efficiently radiated toward audience mn. As an application, the patch antenna may be mounted, on not only the seat monitor, on but also a radio access point (base station) or the like.

Thus, patch antenna 5 of the first exemplary embodiment can reduce the Q value showing the sharpness of the peak of the resonance frequency characteristic by increasing the interval between antenna surface 40 and ground surface 10, and can widen the bandwidth of the communication frequency. Patch antenna 5 short-circuits patch 45 with contact 41 of via conductor 54 connected to feeding point 21 on antenna surface 40. Thus, the gain of the communication power on the low frequency side and high frequency side of the communication frequency can be increased and the reduction of the gain can be suppressed, compared with the case in which patch 45 is not conducted to feeding point 21. Therefore, in a wide band including the low frequency side and high frequency side of the communication frequency, the gain of the communication power increases and can widening the bandwidth of the communication frequency is allowed.

As discussed above, patch antenna 5 (one example of antenna device) of the first exemplary embodiment includes: antenna surface 40 having patch 45 (one example of antenna conductor); ground surface 10 that faces antenna surface 40 and has ground conductor 15; and stub 25 configured by interconnecting, in series, first transmission line 27 to third transmission line 29 (one example of the plurality of transmission lines) that have different line widths. Stub 25 is located between antenna surface 40 and ground surface 10. Patch 45 is electrically conducted to stub 25 via feeding point 21 that is connected to first transmission line 27, on the first end side, of first transmission line 27 to third transmission line 29.

Thus, patch antenna 5 can not only increase the interval between the antenna surface and ground surface, but also reduce the Q value (showing the sharpness of the peak of the resonance frequency characteristic) and can widen the bandwidth. Patch 45 is electrically conducted to one end of stub 25, so that the gain as the antenna performance increases in the range of the communication frequency.

First transmission line 27, second transmission line 28, and third transmission line 29 have the same line length. Thus, all line lengths of first transmission line 27 to third transmission line 29 are the same. Therefore, in stub 25, the impedance matching for obtaining a predetermined impedance for matching to the resonance frequency is simply required to be adjusted using the line width, and the impedance matching is simplified.

Furthermore, patch antenna 5 includes substrate 8 made of a dielectric. Substrate 8 is formed of first substrate 8*a* and second substrate 8*b* disposed above first substrate 8*a*. Ground conductor 15 is disposed on the back surface of first substrate 8*a*. Patch 45 is disposed on the front surface of second substrate 8*b*. Stub 25 is disposed on feeding surface 20 between the front surface of first substrate 8*a* and the back surface of second substrate 8*b*. Thus, patch antenna 5 has a three-layer structure including: antenna surface 40 as the uppermost layer; feeding surface 20 as the intermediate layer; and ground surface 10 as the lowermost layer. Stub 25 disposed on feeding surface 20 can feed power to patch 45 disposed on antenna surface 40. The reactance component by the series resonance circuit of stub 25 can cancel the radiation reactance component by the parallel resonance of patch 45. Therefore, bandwidth of the transmission frequency of the radio wave transmitted from patch antenna 5 is widened. The reflection of the radio wave is decreased by widening the bandwidth, and the gain as the antenna performance improves.

Substrate 8 has hole 86 (one example of through hole) that penetrates from the back surface of first substrate 8*a* to the front surface of second substrate 8*b*. Via conductor 54 (one example of feeding conductor) used for feeding power to patch 45 and stub 25 is disposed in hole 86. Thus, patch antenna 5 can easily feed power to both patch 45 and stub 25 from a radio communication circuit through via conductor 54 including feeding point 21.

Stub 25 receives power through via conductor 54 and feeding point 21 disposed on one end side of stub 25. Thus, the stub can feed the communication power to electromagnetically coupled patch.

Patch 45 is a rectangular patch. Thus, the antenna device can be downsized using the patch antenna. The patch antenna can establish the isolation (insulation) between the radiated horizontally polarized radio wave and the vertically polarized radio wave. The patch antenna can not only suppress the interference between the horizontally polarized wave and vertically polarized wave, but also easily form the directionality of the radio communication. Furthermore, when patch antenna 5 is disposed so that its longitudinal direction becomes the horizontal direction and the communication frequency is set in accordance with the longitudinal direction of patch antenna 5, the horizontally polarized radio wave can be efficiently radiated to the vertically polarized radio wave.

Antenna surface 40 is formed in a rectangular shape so as to surround patch 45. Feeding surface 20 having stub 25 in which first transmission line 27 to third transmission line 29 are interconnected in series along the longitudinal direction of patch 45 is formed in a rectangular shape. Ground surface 10 is formed in a rectangular shape so as to surround ground conductor 15. Thus, patch antenna can be molded in a compact rectangular parallelepiped in which the antenna surface, the feeding surface, and the ground surface are stacked, and can be downsized.

In antenna surface 40, patch 45 short-circuits with contact 41 as the end surface of via conductor 54. Thus, patch 45 short-circuits with contact 41 of via conductor 54 on antenna surface 40 outside substrate 8, so that patch 45 can be easily and electrically conducted to feeding point 21, and the patch antenna is easily manufactured.

Various exemplary embodiments have been described with reference to the drawings, but the present disclosure is not limited to this example. The person skilled in the art can clearly come to realize various change example, modification example, replacement example, additional example, deletion example, and equivalence example in a category described in the scope of the claim. These are also recognized to belong to the technical range of the present disclosure naturally. Furthermore, in the range that does not deviate from the purpose of the invention, components in the above-mentioned various exemplary embodiments may be optionally combined.

For example, the patch antenna 5 of the above-mentioned first exemplary embodiment has been described taking, as an example, the use case applied to the antenna of the transmission device for transmitting the radio wave, but may be applied to the antenna of a receiving device for receiving radio wave.

INDUSTRIAL APPLICABILITY

This disclosure does not increase the whole thickness of an antenna device itself, and can be useful as the antenna device that balances widening the bandwidth of the communication frequency and improving the gain as the antenna.

What is claimed is:

1. An antenna device comprising:

a substrate having a three-layer structure including a ground surface stacked at a lower layer, a feeding surface stacked at an intermediate layer, and an antenna surface stacked at an upper layer, wherein the antenna surface has an antenna conductor, wherein the ground surface faces away from the antenna surface and has a ground conductor, wherein the feeding surface has a stub and a feeding point, wherein the stub includes a plurality of transmission lines coupled in series with the feeding point as a starting point, the plurality of transmission lines having different line widths, and wherein the antenna conductor is electrically conducted to the feeding point.

2. The antenna device according to claim 1, wherein the plurality of transmission lines each have a same line length.

3. The antenna device according to claim 1, wherein the substrate includes a dielectric, wherein the substrate includes:

a first substrate; and a second substrate disposed above the first substrate, wherein the ground conductor is disposed on a back surface of the first substrate, wherein the antenna conductor is disposed on a front surface of the second substrate, and wherein the stub is disposed between a front surface of the first substrate and a back surface of the second substrate.

4. The antenna device according to claim 3, wherein the substrate includes a through hole penetrating from the back surface of the first substrate to the front surface of the second substrate, and wherein the through hole includes a feeding conductor for powering the antenna conductor and the stub.

5. The antenna device according to claim 4, wherein the stub is powered via the feeding conductor and via the feeding point.

6. The antenna device according to claim 4, wherein the antenna conductor short-circuits with an end surface of the feeding conductor, on the antenna surface.

7. The antenna device according to claim 1, wherein the antenna conductor includes a rectangular patch.

8. The antenna device according to claim 7, wherein the antenna surface has a rectangular shape around the antenna conductor, the feeding surface has the stub and has a rectangular shape, the stub including the plurality of transmission lines coupled in series along a longitudinal direction of the antenna conductor, and the ground surface has a rectangular shape around the ground conductor.

* * * * *